US005513910A

United States Patent [19]

Ellingwood et al.

[11] Patent Number: 5,513,910

[45] Date of Patent: May 7, 1996

[54] STORAGE COMPARTMENT FOR A REFRIGERATOR

[75] Inventors: John C. Ellingwood; Todd J. Tunzi, both of Galesburg, Ill.

[73] Assignee: Maytag Corporation, Newton, Iowa

[21] Appl. No.: 376,733

[22] Filed: Jan. 20, 1995

[51] Int. Cl.[6] ..... A47B 96/02

[52] U.S. Cl. ..... 312/405.1; 312/298; 312/310; 312/327; 211/88; 211/99; 211/106; 211/168; 248/240; 248/240.1

[58] Field of Search ..... 312/405.1, 298, 312/309, 310, 327; 211/88, 99, 106, 168; 248/240, 240.1

[56] References Cited

U.S. PATENT DOCUMENTS

| | | | |
|---|---|---|---|
| 1,810,769 | 6/1934 | Jaden . | |
| 2,062,360 | 12/1936 | Goulooze | 312/405.1 X |
| 2,155,967 | 4/1939 | Carroll . | |
| 2,381,598 | 8/1945 | Jones | 312/298 X |
| 2,576,691 | 11/1951 | Money . | |
| 2,808,310 | 10/1957 | Patterson, Jr. | 312/310 X |
| 3,817,395 | 6/1974 | LeFever . | |
| 5,193,892 | 3/1993 | Swindell | 312/405.1 |

FOREIGN PATENT DOCUMENTS

| | | | |
|---|---|---|---|
| 534642 | 1/1955 | Belgium | 312/327 |
| 1116644 | 5/1956 | France | 312/298 |
| 1335491 | 7/1963 | France | 211/88 |
| 503777 | 4/1939 | United Kingdom | 312/327 |

*Primary Examiner*—Peter M. Cuomo
*Assistant Examiner*—Rodney B. White
*Attorney, Agent, or Firm*—Mark W. Borgman

[57] ABSTRACT

A storage compartment for a refrigerator door is disclosed which includes a recess formed in the door liner of the refrigerator. The recess is provided with pivot connections and a pivot stop. A rack is provided that is made to allow viewing of the contents. The rack is rotatably insertable into the recess defined by the door liner and can then be rotated forwardly from the door until the rack comes into contact with the stop on the door. In the rotated state, the contents of the rack may be easily accessed and removed. The rack is further designed so that if the door is shut while the rack is in an open position the rack will not contact the cabinet wall, preventing damage to the cabinet and the rack.

6 Claims, 4 Drawing Sheets

STORAGE COMPARTMENT FOR A REFRIGERATOR

BACKGROUND OF THE INVENTION

The present invention relates to a refrigerator compartment for storage of articles such as soft goods. The compartment is particularly useful in the refrigerator freezer compartment, but can also be used in the refrigerator fresh food compartment.

Previous refrigerator door compartments typically fall into two constructions. In one construction, the door includes a recess which is open on the top with a retaining wall or bar across the front. This is useful for larger solid items such as bottles and boxes of goods. In the second the door includes a recess which is enclosed and can be opened via, for example, a door or a lid. The enclosed compartment provides some benefits for keeping foods fresher. Some of the enclosed compartments have been provided with a pivoting mechanism that allows the consumer access via the top of the compartment when it is pivoted away from its retaining wall.

Neither of these constructions is well suited for soft packaged goods which include plastic packages of vegetables and other refrigerated items. The packages are not retained adequately by the compartment first described above, as the packages may slip out of the shelf under or over the retaining wall. The consumer is further limited as to how many packages may be placed into the compartment before packages fall over the wall or bar, thus preventing an efficient utilization of the limited space inside the refrigerator. Additionally, the retaining wall or bar may prevent viewing of the contents of the compartment under the top layer of packages.

The substantially enclosed compartment described above is not well suited to soft goods either. These enclosed compartments typically increase the cost and complexity of the compartment. The traditional design used in enclosed compartments also does not include a transparent wall, again preventing the consumer from identifying all of the soft goods stored in the limited space.

Therefore a primary objective of the present invention is to provide a refrigerator door compartment that allows the consumer to enhance the utilization of space.

A further object of the present invention is the provision of a storage compartment for a refrigerator door that allows the consumer to view the contents while the compartment is in place.

A further object of the present invention is the provision of a storage compartment for a refrigerator door that permits easy removal and addition of packages.

SUMMARY OF THE INVENTION

The foregoing objects are achieved by a storage compartment for a refrigerator comprising a refrigerator door having an outer shell and an inner liner, with the inner liner having a recess including first and second side walls, a bottom wall, a top wall, a back wall and a stop flange on the first side wall. The compartment further includes a rack pivotally mountable in the recess of the liner including a bottom wall, first and second side walls, a back wall, a front wall and providing a closed position wherein the bottom of the rack is substantially resting on the bottom wall of the recess. Upon forward rotation of the rack from the closed position, the rack contacts the first stop flange at a predetermined open position to prevent further forward rotation.

The storage compartment can further include a rack having tapered side walls narrowing the width of the front wall at the top of the rack so that the taper of the side walls prevents the rack from contacting the freezer if the door is closed with the shelf in an open position.

DETAILED DESCRIPTION OF THE PREFERRED EMBODIMENT

Figure 1:
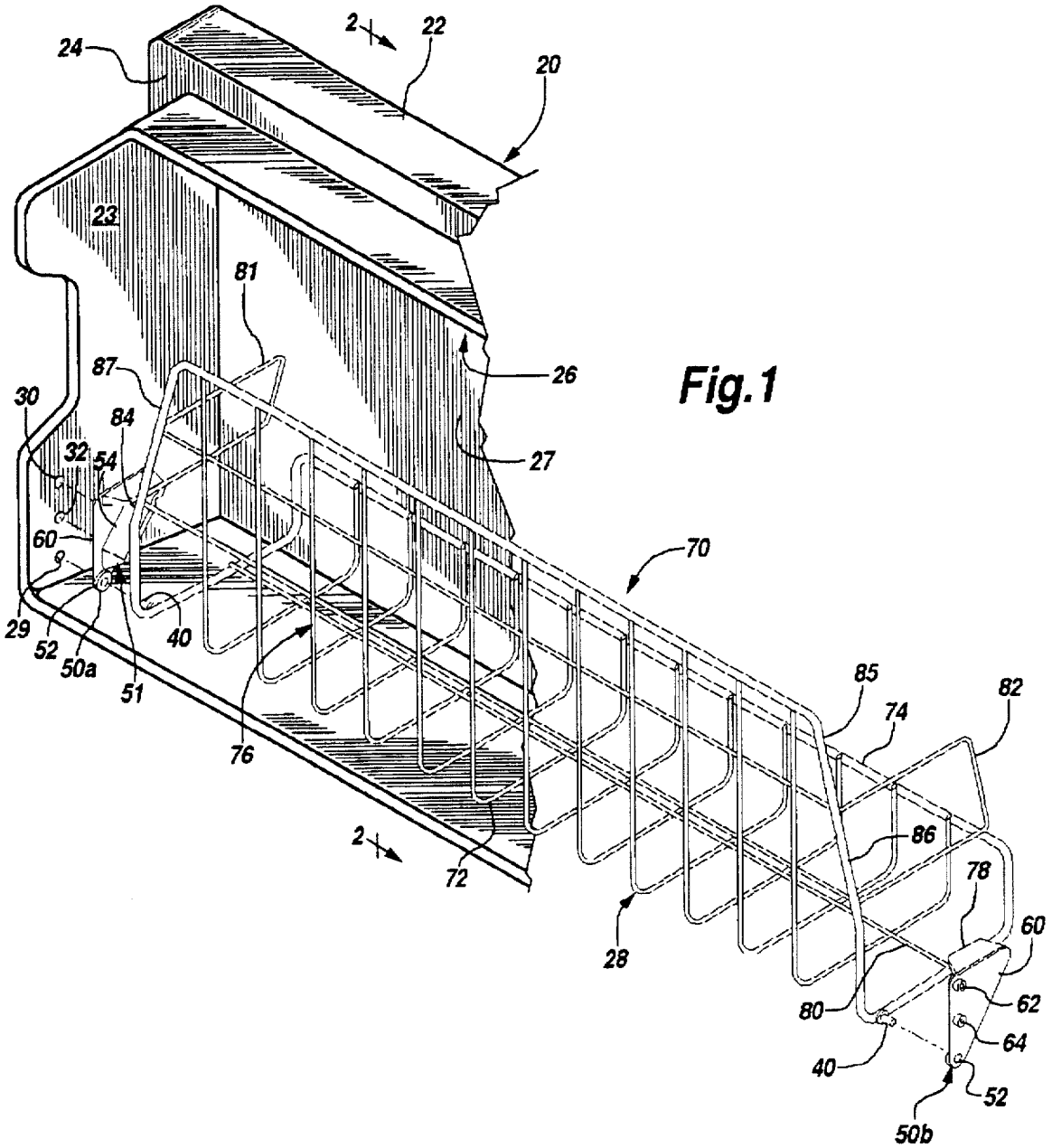
FIG. 1 is an exploded isometric view of a rack system.
Figure 2:
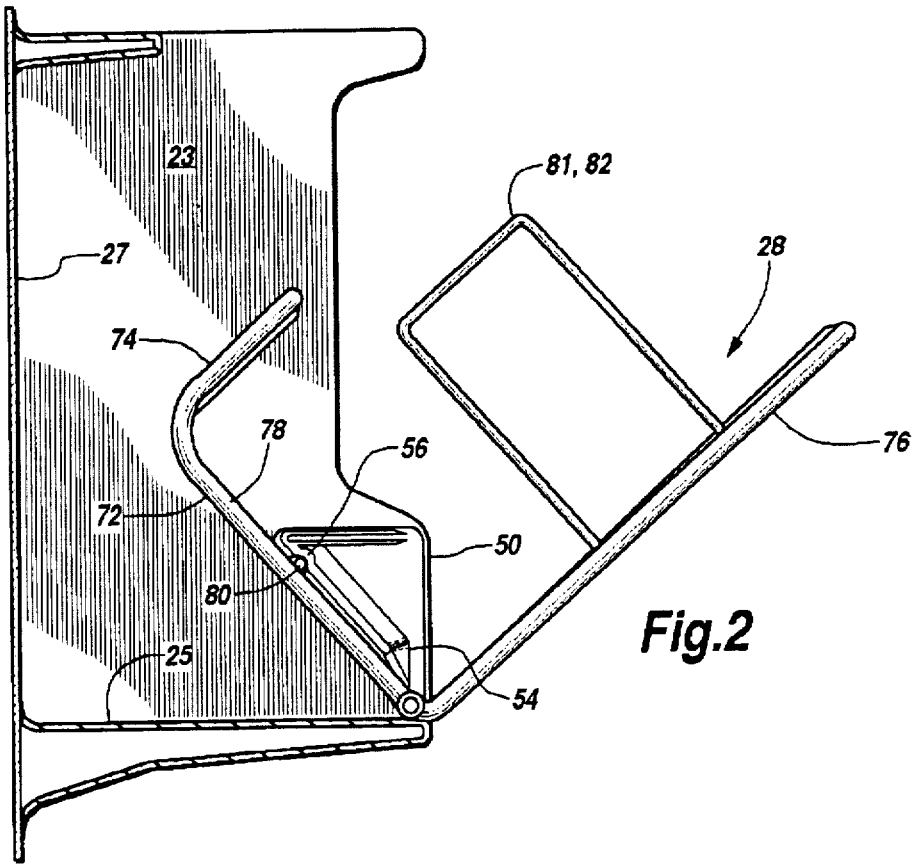
FIG. 2 is a view along 1—1 of a storage compartment and rack.
Figure 3:
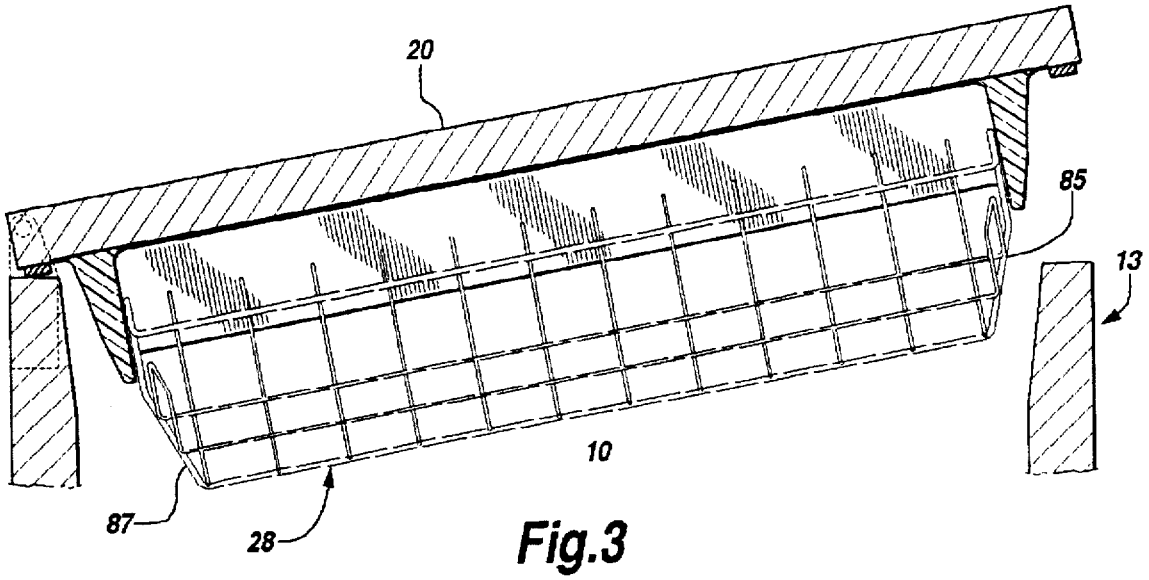
FIG. 3 is a bird's eye view of the rack with the appliance door partially closed.

Referring to FIGS. 1–3, a freezer door 20 is shown. The freezer door 20 is formed of an outer shell 22 and an inner liner 24. The inner liner 24 is formed to provide a recess 26. A rack 28 formed of coated wire, molded plastic or other suitable material is provided to fit within the recess 26. This rack 28 is pivotally mounted in the recess 26 as will be explained in detail below.

Referring to FIGS. 1–2, the rack 28 includes a pivot shaft 40 at each end. A first mounting bracket 50*a* which has a front side 51 and a back side 60 is provided at one end of the recess 26. A second mounting bracket 50*b* is provided at the other end of the recess 26. The mounting brackets 50 are preferably formed of a molded plastic material although other suitable materials such as metal may also be used. The mounting brackets 50 further include a pivot shaft receptacle 52 to rotatably receive one of the pivot shafts 40 of the rack 28. The inner liner 24 includes receiving piercings 29 which align with the pivot shaft receptacle 52 when the mounting brackets 50 are attached to the inner liner 24. The mounting brackets 50 each include a stop 54 which is a raised flange on the surface of the front side 51 of the mounting brackets 50. The stop 54 includes an indented portion 56 at one end which fits around the wire 80 of the rack 28 when the rack is fully opened, as best shown in FIG. 2. The backside 60 of the mounting brackets 50 includes two bosses 62,64 which mate with corresponding piercings 30,32 in the inner liner 24 within the recess 26.

The mating of the bosses 62,64 on the mounting brackets 50 to the piercings 30,32 in the inner liner 24 provides a means of locating the mounting brackets 50 into recess 26 of the inner liner 24. The bosses 62,64, when mated to the piercings 30,32 in the inner liner 24 are positioned to be load bearing members for supporting the rack 28. The load of the rack 28 is carded by the bosses 62,64 in the piercings 30,32 and by the pivot shaft 40 in the mounting brackets 50 and inner liner 24 as described later. The mating of the bosses 62,64 on the mounting brackets 50 to the piercings 30,32 in the inner liner 24 further secures the mounting brackets 50 to the inner liner 24 via an interference fit. The mounting brackets 50 can also be attached with glue, fasteners or any other means of firmly holding the mounting brackets 50 in place.

While holding the rack 28 with the open end 70 upright, the side walls 23 of the inner liner 24 can be flexed slightly to allow the pivot shafts 40 to fit within the pivot shaft receptacles 52. The pivot shafts 40 extend through the pivot shaft receptacles 52 of the mounting bracket 50 into the receiving piercing 29 of the inner liner 24, thereby increasing the load bearing capability. In its closed position, the bottom wall 72 of the rack 28 is generally resting upon the bottom wall 25 of the recess 26 and the back wall 74 of the rack 28 is parallel to the back wall 27 of the recess 26. The front wall 76 of the rack 28 generally covers and encloses the recess 26.

The rack 28 can be rotated about the pivot shafts 40 so that the front wall 76 of the rack 28 moves forward and downward as shown in FIG. 2. The end wall 78 of the rack 28 moves upward and forward until it comes into contact with the stop 54 on the mounting bracket 50. The end wall 78 of the rack 28 mates with the stop 54 with the indented portion 56 fitting around a wire 80 on the bottom 72 of the rack 28. In this way, the progress of the rack 28 is halted with the top 70 of the rack 28 exposed to allow the user easy access to the contents of the rack 28.

The rack 28 includes end guards 81,82 projecting from the sides 84,86 of the rack 28 towards the back of the compartment. The end guards 81, 82 prevent articles from falling out of the rack 28 when it is rotated to the open position. The sides 84,86 are formed with a slight taper indicated at 85,87 toward the center of the rack. The taper of the sides 84,86 is such that if the user of the rack 28 leaves the rack 28 in the open position and closes the freezer door 20, the side 84 will not contact the side wall 13. This is best illustrated in FIG. 3. In FIG. 3, the door 20 is partially closed with the side 84 of the rack 28 entering the refrigerator 10 without contacting the side wall 13. This prevents damage to the rack 28 or the front wall 13 in the event the user closes the door 20 with the rack 28 in the open position.

After the rack 28 is accessed by the user, the rack 28 can be rotated about the pivot shafts 40 upward and rearward back to the closed position. In this position the products within the rack 28 are held in place by the rack 28 and the confines of the recess 26. The front wall 76 of the rack 28 and the recess 26 cooperate to effectively close the recess 26 and prevent goods from exiting the rack 28.

Figure 4:
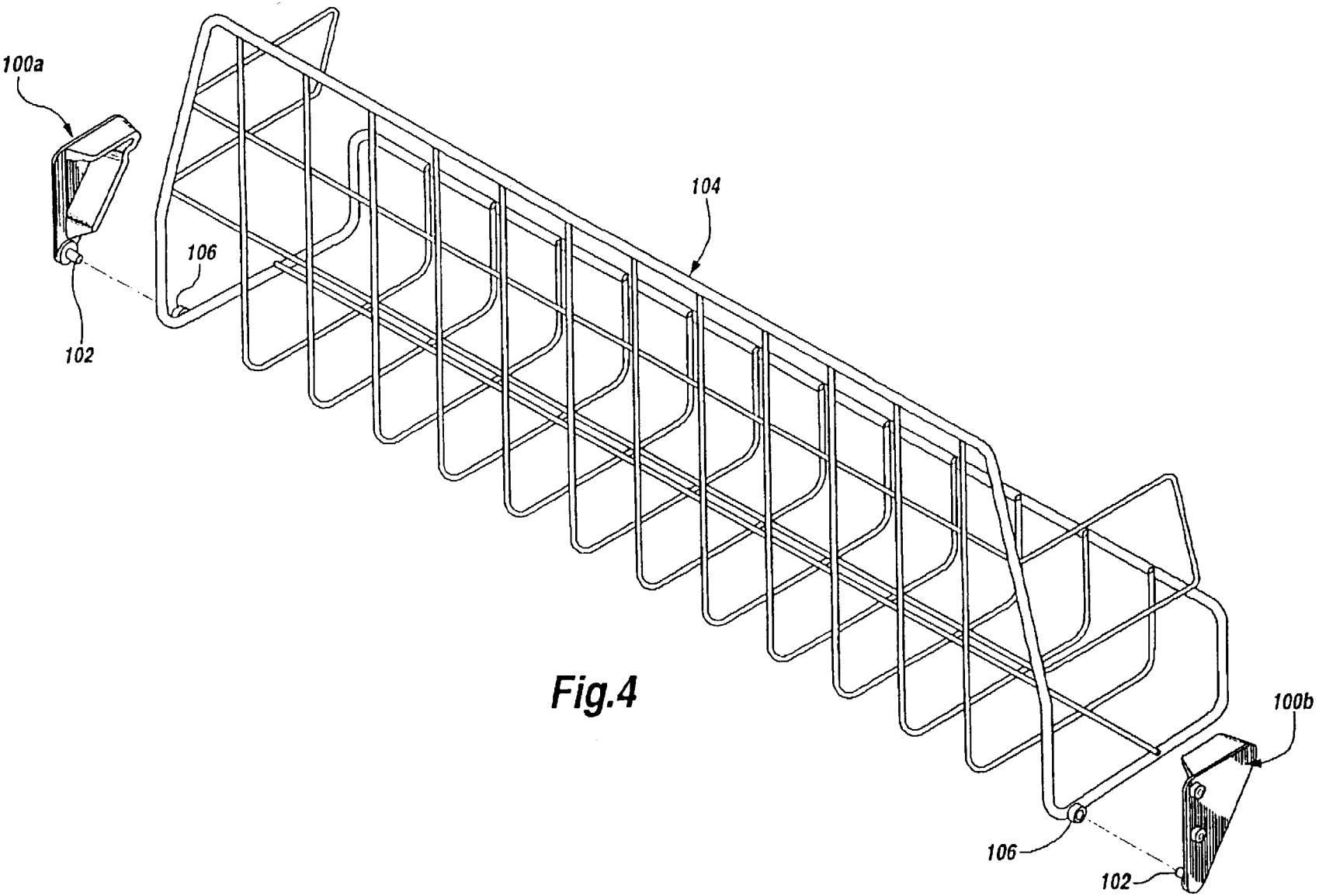
FIG. 4 is an exploded view of an alternative embodiment of a rack.

An alternative arrangement is shown in FIG. 4. In this arrangement, each of the mounting brackets 100*a*, 100*b* include a pivot shaft 102. The rack 104 includes pivot shaft receptacles 106 for rotatably receiving the pivot shafts 102. Other elements and functions of the storage compartment remain the same as described above.

Figure 5:
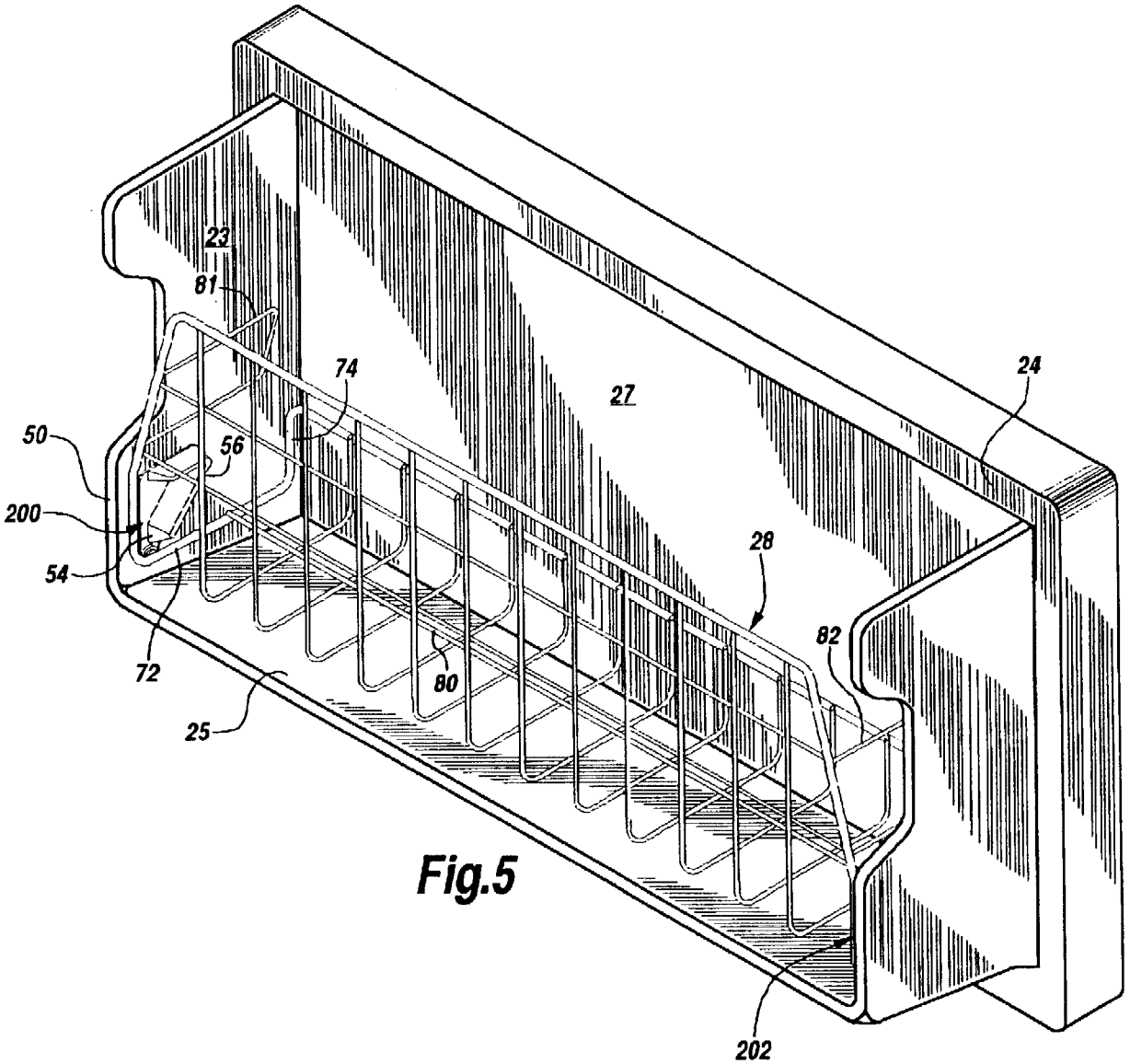
FIG. 5 is a perspective view of an alternative embodiment of a rack.

In yet another embodiment, shown in FIG. 5, the mounting brackets 200,202 are integrally formed into the inner liner 24. This eliminates the need for the bosses 62,64 and corresponding piercings 30,32. Other elements of the invention remain as described previously.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A storage compartment for a refrigerator comprising:

a refrigerator door having an outer shell and an inner liner;

the inner liner having a recess including first and second side walls, a bottom wall, a top wall and a back wall;

a first mounting bracket attached to the first recess side wall and a second mounting bracket attached to the second recess side wall;

a stop located on the first mounting bracket;

a rack pivotally mounted to the mounting brackets in the recess of the liner;

the rack including front, bottom, and back walls and two end walls; the front wall of the rack having a center;

the front wall having a first side and a second side directly attached to the end walls of the rack;

the first and second sides having a portion tapered toward the center of the front wall of the rack;

end guards projecting from each of the first and second sides of the front wall of the rack;

wherein upon forward rotation of the rack, the rack contacts the stop at a predetermined open position to prevent further forward rotation.

2. The storage compartment of claim 1 wherein: the rack includes a first pivot shaft and a second pivot shaft; the first mounting bracket includes a first pivot shaft receptacle for rotatably receiving the first pivot shaft and the second mounting bracket includes a second pivot shaft receptacle for rotatably receiving the second pivot shaft.

3. A storage compartment for a refrigerator comprising:

a refrigerator door having an outside shell and an inner liner; the inner liner having a recess including first and second side walls, a bottom, a top wall and a back wall;

a first mounting bracket attached to the first recess side wall and a second mounting bracket attached to the second recess side wall, each mounting bracket including a pivot shaft;

a stop located on the first mounting bracket;

a rack rotatably receiving the first and second pivot shafts, the rack providing a closed position wherein a bottom wall of the rack is substantially resting on the inner liner recess bottom wall;

the rack including front, bottom, and back walls and two end walls;

the front wall of the rack having a center;

the front wall having a first side and a second side directly attached to the end walls of the rack;

the first and second sides having a portion tapered toward the center of the front wall of the rack;

end guards projecting from each of the first and second sides of the front wall of the rack;

wherein upon forward rotation of the rack from the closed position, the rack contacts the stop at a predetermined open position to prevent further forward rotation.

4. The storage compartment of claim 3 further comprising:

the first mounting bracket having a pair of bosses and the second mounting bracket having a pair of bosses;

the first and second liner recess side walls having piercings formed to receive the bosses.

5. The storage compartment of claim 3 comprising:

the rack having a rear wall to retain the contents of the rack upon forward rotation to the open position.

6. A storage compartment for a refrigerator comprising:

a refrigerator door having an outer shell and an inner liner;

the inner liner having a recess including first and second side walls, a bottom wall, a top wall and a back wall;

a first mounting bracket attached to the first recess side wall and a second mounting bracket attached to the second recess side wall;

a stop located on the first mounting bracket;

a rack pivotally mounted into the mounting brackets and formed to fit within the recess of the liner;

the rack further including front, bottom, back walls and two end walls, the front wall of the rack including a first side, a second side and a center, the first and second sides of the front wall of the rack being directly attached to the end walls of the rack, having a portion tapered toward the center of the front wall of the rack;

ends guards projecting from each of the first and second sides of the front wall of the rack;

the first mounting bracket having a pair of bosses and the second bracket having a pair of bosses;

the rack having a first pivot shaft at one end and a second pivot shaft at the opposite end;

a first and second piercing in the first liner side wall formed to securely receive the bosses located on the first mounting bracket;

a third and fourth piercing in the second liner side wall formed to securely receive the bosses located on the second mounting bracket;

a first pivot shaft receptacle located on the first mounting bracket to rotatably receive the first pivot shaft and a second pivot shaft receptacle located on the second mounting bracket to rotatably receive the second pivot shaft;

a fifth piercing in the first liner recess side wall formed to rotatably receive the first pivot shaft and a sixth piercing in the second liner recess side wall formed to rotatably receive the second pivot shaft;

wherein upon insertion of the bosses on the first mounting bracket into the first and second piercings and insertion of the bosses on the second mounting bracket onto the third and fourth piercings and insertion of the first pivot shaft in the pivot shaft receptacle on the first mounting bracket and the fifth piercing and insertion of the second pivot shaft in the second pivot shaft receptacle on the second mounting bracket and the sixth piercing, the piercings each act as load bearing surfaces;

wherein upon forward rotation of the rack, the rack contacts the stop at a predetermined open position to prevent further forward rotation.

* * * * *

UNITED STATES PATENT AND TRADEMARK OFFICE

CERTIFICATE OF CORRECTION

PATENT NO. : 5,513,910
DATED : May 7, 1996
INVENTOR(S) : John C. Ellingwood et al It is certified that error appears in the above-indentified patent and that said Letters Patent is hereby corrected as shown below:

In Column 5, line 11, after "rack," insert -- the first and second sides of the front wall of the rack --

In Column 5, line 13, "ends" should read -- end --

Signed and Sealed this

Tenth Day of December, 1996

*Attest:*

*Attesting Officer*

BRUCE LEHMAN

*Commissioner of Patents and Trademarks*